US006131747A

United States Patent [19]

Kin

[11] Patent Number: 6,131,747

[45] Date of Patent: Oct. 17, 2000

[54] METHOD AND APPARATUS FOR DISPLAYING FLOOR COVERING AND OTHER FLEXIBLE MATERIALS

[75] Inventor: Henry R. Kin, Cincinnati, Ohio

[73] Assignee: Kin Products, Inc., Cincinnati, Ohio

[21] Appl. No.: 09/193,437

[22] Filed: Nov. 17, 1998

[51] Int. Cl.[7] ..... A47F 7/16

[52] U.S. Cl. ..... 211/45; 248/316.7

[58] Field of Search ..... 248/316.2, 316.7; 211/45, 89.01

[56] References Cited

U.S. PATENT DOCUMENTS

| | | | |
|---|---|---|---|
| 451,182 | 4/1891 | Gaillac . | |
| 626,089 | 5/1899 | Pancoast . | |
| 633,237 | 9/1899 | Egbert . | |
| 1,180,698 | 4/1916 | Coupland . | |
| 3,399,429 | 9/1968 | Goodman . | |
| 3,671,004 | 6/1972 | Cram . | |
| 3,805,873 | 4/1974 | Bloomfield . | |
| 4,067,537 | 1/1978 | Pejrud . | |
| 4,324,337 | 4/1982 | Hermalahti . | |
| 4,326,727 | 4/1982 | Rock | 248/309.1 X |
| 4,446,974 | 5/1984 | Ott | 211/45 |
| 4,534,145 | 8/1985 | Yang et al. . | |
| 4,682,697 | 7/1987 | Cohen | 211/45 |
| 4,694,543 | 9/1987 | Conley . | |
| 4,799,299 | 1/1989 | Campbell . | |
| 5,170,982 | 12/1992 | Schutheis et al. . | |
| 5,251,766 | 10/1993 | Barry . | |
| 5,384,941 | 1/1995 | Welser . | |
| 5,715,949 | 2/1998 | Rutledge | 211/89.01 |

*Primary Examiner*—Ramon O. Ramirez
*Attorney, Agent, or Firm*—Dinsmore & Shohl LLP

[57] ABSTRACT

An apparatus and method for displaying floor covering or other flexible material comprises an elongate housing and an elongate locking pin. The elongate housing has walls which define a cavity having an upper portion and a lower portion, a transition between the upper portion and the lower portion of the cavity, and a pair of oppositely spaced inwardly disposed locking lips which define an opening of the lower portion of the cavity.

20 Claims, 7 Drawing Sheets

METHOD AND APPARATUS FOR DISPLAYING FLOOR COVERING AND OTHER FLEXIBLE MATERIALS

FIELD OF THE INVENTION

The present invention relates to display methods and devices, and will be specifically disclosed as a method and device for displaying floor covering and other flexible materials. A preferred device comprises a housing having a multi-portioned cavity and a transition, into which flexible material is inserted. A locking pin is thereafter inserted to secure the material within at least a part of the housing cavity.

BACKGROUND OF THE INVENTION

Floor covering material can take a variety of different forms. Some examples of floor covering materials include rugs, mats, runners, padding, carpets, carpet protectors, linoleum, and the like. In a variety of circumstances, it is desirable to display floor covering materials. For instance, in retail settings, floor covering materials are often hung relative to one another so that consumers may conveniently view or otherwise inspect the floor covering material. The floor covering material can come in a variety of dimensions ranging from a few inches in length to several feet. For example, some rugs are over 8 foot wide and over 11 foot long. Such coverings are often stacked on top of each other, saving floor space but making viewing and comparisons among colors and patterns difficult. Sometimes, coverings are hung on walls or displays, but there is generally only limited wall and/or display space available.

In displaying floor covering material, several features are desired. These features include: ease of use, protection of the floor covering material from damage, inhibition of stretching of the floor covering material and overall decorative presentation and appearance.

Various difficulties and problems are encountered in providing a suitable means for securing and displaying floor covering material. In hanging floor covering material to a supporting surface, conventionally separate devices have been employed. One such device comprises a hook which is generally semi-permanently embedded in the floor covering material, and another example would be a supporting line or rod associated with the supporting surface in which the hooks from the floor covering material are connected to the supporting rod or line.

Those conventional arrangements are objectionable in consequence of the above-defined structure, in that the hooks are semi-permanently embedded in the floor covering material, and in that the floor covering material tends to sag where no hook is attached. This distracts from the general decorative appearance of the floor covering material being displayed.

Accordingly, the present invention provides an improved hanger means for displaying floor covering material which improves on several of the deficiencies of conventional floor covering material displaying techniques known to one skilled in the art.

SUMMARY OF THE INVENTION

One aspect of the present invention is the provision of a new apparatus for displaying floor covering material. The apparatus comprises an elongate housing and an elongate locking pin which is slid into the housing to selectively hold floor covering material. The elongate housing has walls which define a cavity. The cavity includes an upper portion, a lower portion, and a transition between the upper and lower portions. A pair of oppositely spaced, inwardly disposed locking lips define an opening in the lower portion of the cavity, and the elongate locking pin is dimensioned to fit into the lower portion of the cavity for securing a floor covering material in the housing.

Another aspect of the present invention is a new method for displaying floor covering material. An elongate housing is provided which has a cavity and a pair of oppositely spaced, inwardly disposed locking lips which define an opening to the cavity. A portion of a floor covering material is inserted into the cavity, and an elongate locking pin, dimensioned to fit into the lower portion of the cavity, is provided. The elongate locking pin is inserted into the cavity to secure the floor covering material in the elongate housing. The elongate housing is then secured as desired to display the floor covering material.

Still other objects, advantages, and novel features of the present invention will become apparent to those skilled in the art from the following description of the preferred embodiment, which is simply by way of illustration one of the best modes contemplated for carrying out the invention. As will be realized, the invention is capable of other different obvious aspects all without departing from the invention. Accordingly, the drawings and the description are illustrative in nature and not restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENTS

Reference will now be made in detail to the present preferred embodiments of the invention, an example of which is illustrated in the accompanying drawings, wherein the numerals indicate the same elements throughout the views.

Figure 1:
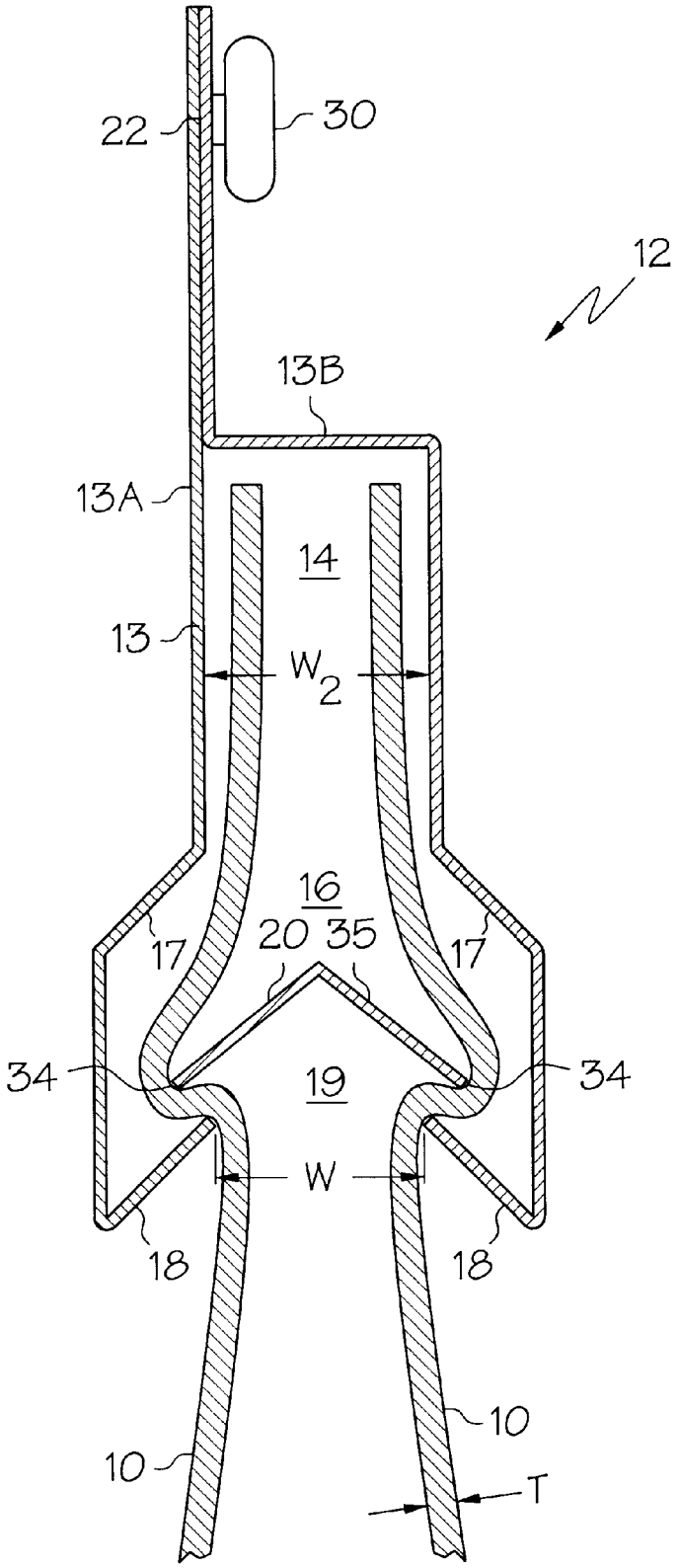
FIG. 1 is an end view of a preferred embodiment of an apparatus for displaying floor covering and other flexible materials.
Figure 2:
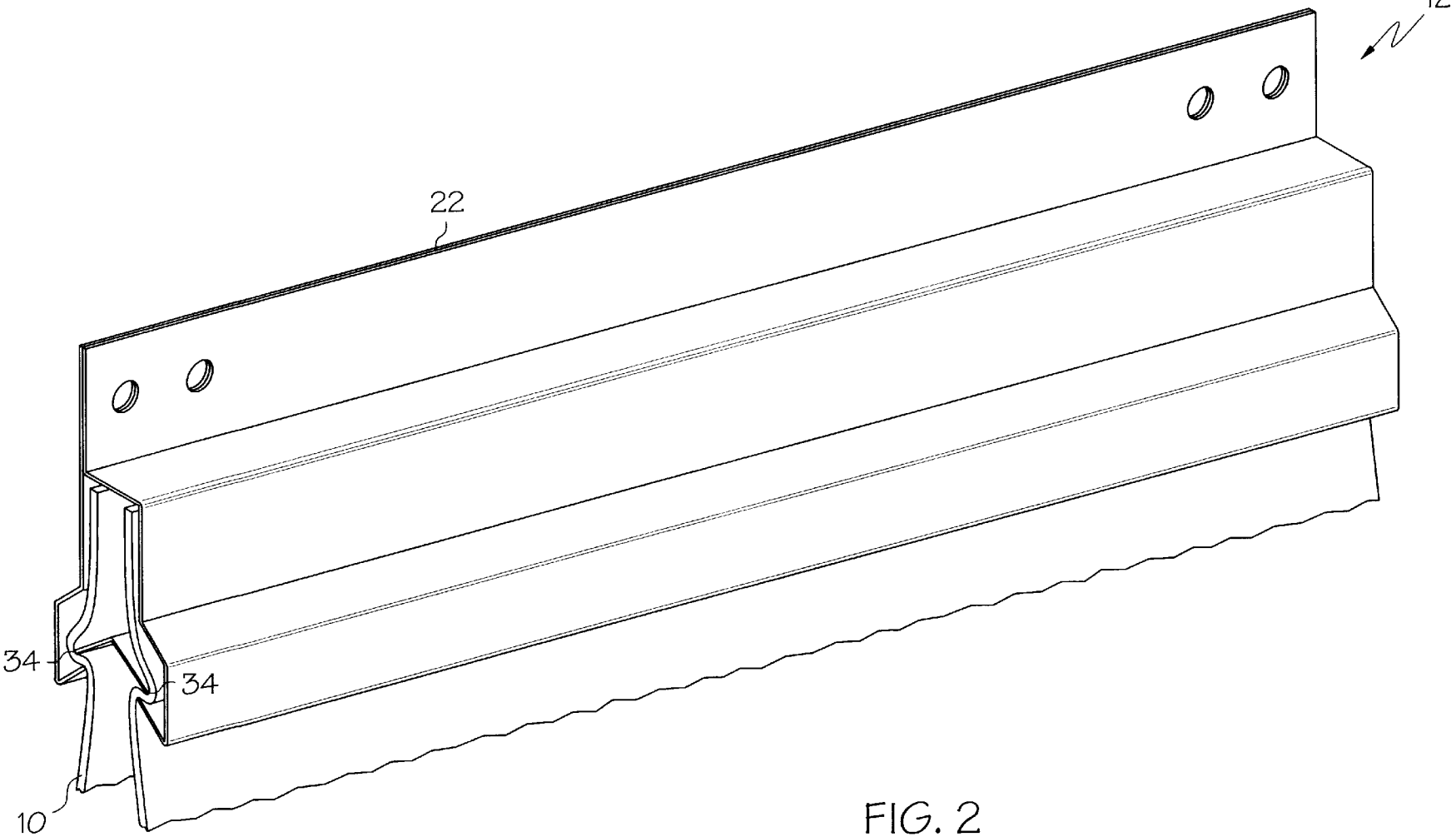
FIG. 2 is a longitudinal view of the apparatus for displaying floor covering and other flexible materials.

FIGS. 1 and 2 depict a preferred embodiment of the invention. For example, a flexible floor covering material 10 such as a rug or piece of flexible linoleum or other material is secured within the elongate housing 12. As shown here, the housing 12 might be provided in the form of two sheets of steel bent as shown in the figures. The two sheets can be joined to one another by welding or other appropriate means known to one skilled in the art, to form an integral flange 22. For certain applications, the elongate housing can range in longitudinal length from about 1 inch to about 80 inches, more preferably from about 20 inches to about 70 inches, and most preferably from about 30 inches to about 66 inches. Obviously, the longitudinal length of any particular embodiment could vary as desired. Alternatively, the housing might be provided in the form of an extruded piece, cast, molded, or machined. The materials of the elongate housing can be steel, alloy, plastic, composite, aluminum, or any other material known to one skilled in the art.

The elongate housing 12 comprises walls 13 which define a cavity. In the embodiment shown in FIGS. 1 and 2, the cavity preferably includes an upper portion 14 and a lower portion 16. For applications of the invention such as for displaying area rugs or the like, the upper portion of the cavity ranges in width from about 0.1 inches to about 5 inches, more preferably from about 0.5 inches to about 2.5 inches and most preferably from about 1.06 inches to about 2.0 inches. For such applications, the lower portion of the cavity ranges in width from about 1 inch to about 5 inches, more preferably from about 1.5 inches to about 3.5 inches and most preferably from about 2.24 inches to about 3 inches. Similarly, the upper portion of the cavity ranges in height from about 0.5 inches to about 30 inches, more preferably from about 1.5 inches to about 10 inches and most preferably from about 1.975 inches to about 5 inches. The height of the lower portion of the cavity ranges from about 0.5 inches to about 12 inches, more preferably from about 1.0 inches to about 6 inches and most preferably from about 1.31 inches to about 3 inches. In other embodiments of the present invention, the upper portion of the cavity could be rounded, concave, convex, rectangular, slanted, or the like. It should be understood that the specific sizes and shapes of the housing elements of the present invention may vary depending on the application, flexible material to be secured, and materials from which the housing and the locking elements discussed below are provided. The exemplary ranges provided herein are intended only as a preferred example to better describe the invention generally.

The elongate housing 12 further comprises a transition (shown generally at 17) between the upper portion 14 of the cavity and the lower portion 16 of the cavity. The transition 17 can be any structure which prevents the locking pin 20 from being displaced from its secured position and/or from entering the upper portion 14 of the cavity when a floor covering material 10 is present in the cavity. The transition 17 is to provide structure adjacent the lower portion of the cavity to limit undesirable repositioning of locking pin 20 once it has been slid into housing 12, while permitting access between upper portion 14 and lower portion 16 to accommodate the flexible material without undue binding or interference. As shown, transition 17 can preferably comprise angled walls connecting portions of the cavity which effectively change the volume of the cavity, and keep the locking pin 20 in the lower portion of the cavity in order to keep pressure on the floor covering material 10 against the locking lips 18 of the elongate housing 12. The transition element or structure can range in length from about 0.1 inches to about 10 inches, more preferably from about 0.5 inches to about 5 inches and most preferably from about 0.682 inches to about 2.0 inches.

Figure 4:
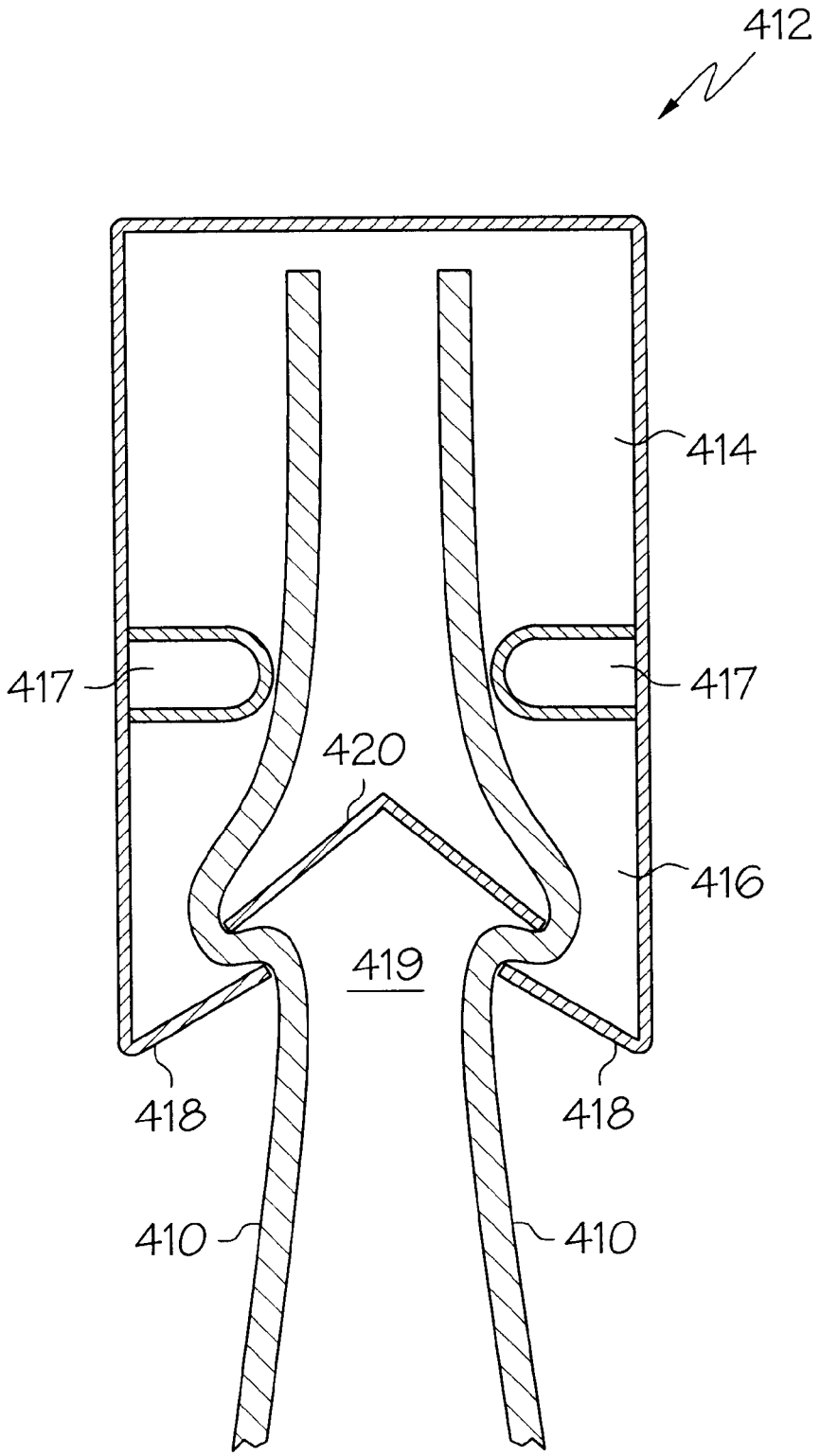
FIG. 4 is an end view of another embodiment of an apparatus for displaying floor covering and other flexible materials.

As seen in the alternate embodiments of FIGS. 4–7, the housing and its transition can take on quite varied structures and shapes. In FIG. 4, the elongate housing 412 comprises a cavity having an upper portion 414 and a lower portion 416. The elongate housing 412 further comprises a transition (shown generally at 417) between the upper portion 414 and the lower portion 416 of the cavity. The elongate housing 412 further comprises a pair of oppositely spaced inwardly disposed locking lips 418 which define an opening 419 of the lower portion 416. The apparatus also comprises an elongate locking pin 420 dimensioned to fit into the lower portion 416 of the cavity for securing a floor covering material 410 in the housing 412.

Figure 5:
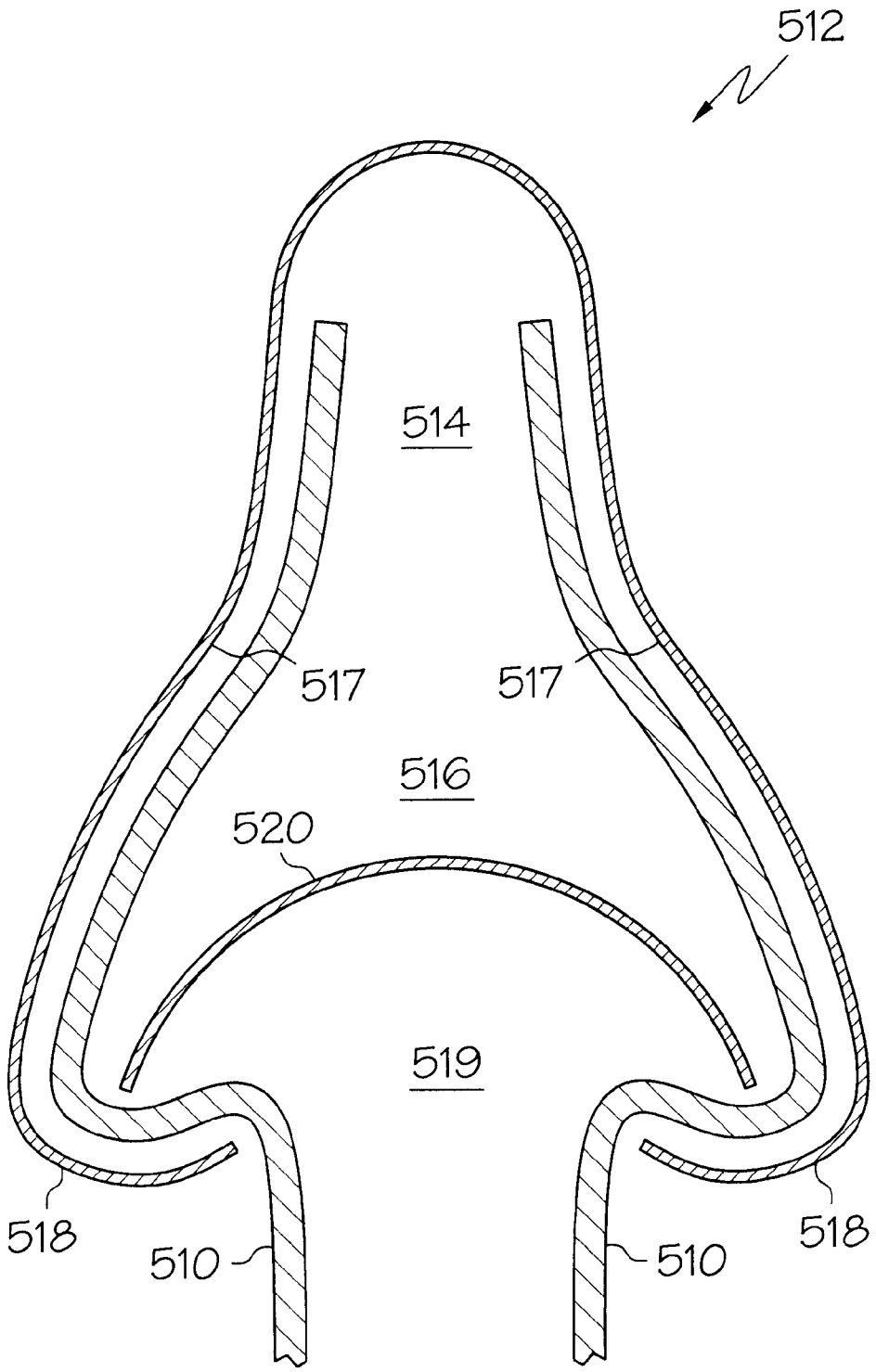
FIG. 5 is an end view of another embodiment of an apparatus for displaying floor covering and other flexible materials.

In FIG. 5, the elongate housing 512 comprises a cavity having an upper portion 514 and a lower portion 516. The elongate housing 512 further comprises a transition (shown generally at 517) between the upper portion 514 and the lower portion 516 of the cavity. The elongate housing 512 further comprises a pair of oppositely spaced inwardly disposed locking lips 518 which define an opening 519 of the lower portion 516. The apparatus also comprises an elongate locking pin 520 dimensioned to fit into the lower portion 516 of the cavity for securing a floor covering material 510 in the housing 512.

Figure 6:
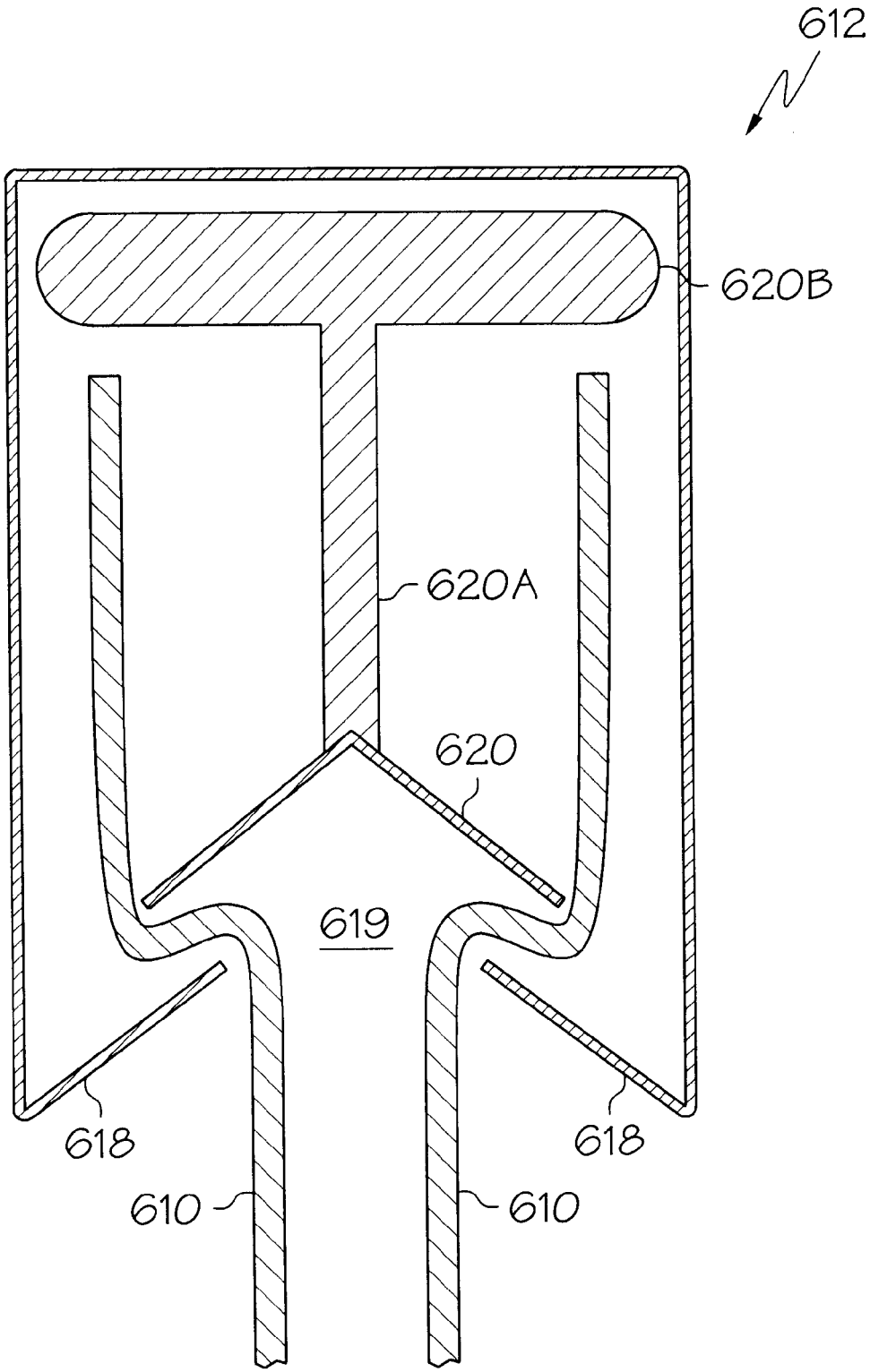
FIG. 6 is an end view of another embodiment of an apparatus for displaying floor covering and other flexible materials.

In FIG. 6, the elongate housing 612 comprises a cavity. The elongate housing 612 further comprises a pair of oppositely spaced inwardly disposed locking lips 618 which define an opening 619 of the cavity. The apparatus also comprises an elongate locking pin 620 dimensioned to fit into the cavity for securing a floor covering material 610 in the housing 612. The elongate locking pin 620 further comprises a vertical member **620*a* connected to the elongate locking pin 620. The elongate locking pin further comprises a horizontal member 620*b* connected to the vertical member at the end distal to the elongate locking pin 620**. This embodiment of the present invention eliminates the need for a transition in the elongate housing.

Figure 7:
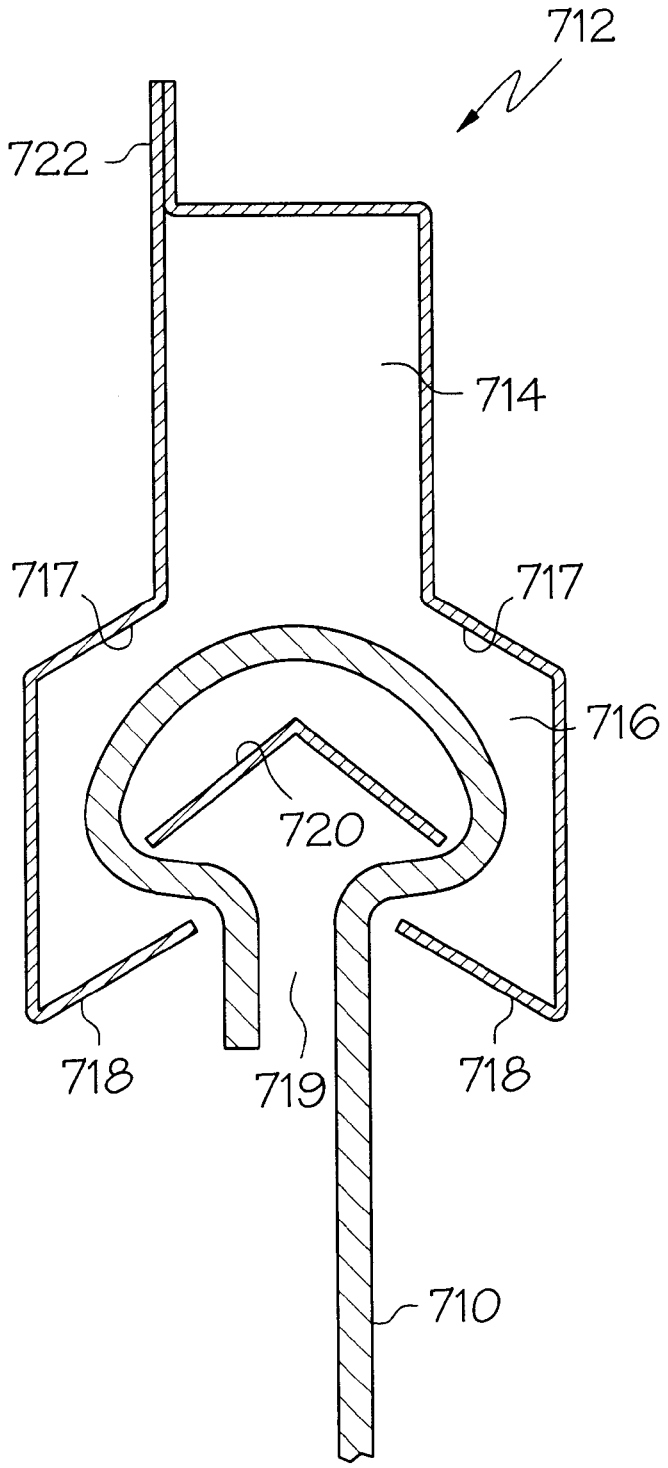
FIG. 7 is an end view of another embodiment of an apparatus for displaying floor covering and other flexible materials.

In FIG. 7, the elongate housing 712 comprises a cavity having an upper portion 714 and a lower portion 716. The elongate housing 712 further comprises a transition (shown generally at 717) between the upper portion 714 and the lower portion 716 of the cavity. The elongate housing 712 further comprises a pair of oppositely spaced inwardly disposed locking lips 718 which define an opening 719 of the lower portion 716. The apparatus also comprises an elongate locking pin 720 dimensioned to fit into the lower portion 716 of the cavity for securing a floor covering material 710 in the housing 712. In this embodiment of the present invention, one end of the flexible material is looped in the elongate housing 712 and the elongate locking pin 720 is then inserted into the housing to secure the flexible material.

As shown in FIGS. 1 and 2, the elongate housing 12 further comprises a pair of oppositely spaced inwardly disposed locking lips 18 which define an opening 19 of the lower portion 16. As shown here, the locking lips are preferably inwardly and upwardly disposed, and are locked adjacent to the open lower surface of the housing. It is preferred that lips 18 be situated at least partially within the cavity. In other embodiments, however, the locking lips can be parallel to one another or downwardly disposed. Optionally, the locking lips can include teeth for gripping the floor covering material.

The apparatus also comprises an elongate locking pin 20 dimensioned to fit into the lower portion 16 of the cavity for securing a floor covering material 10 in the housing 12. In a conventional arrangement for area rugs or similar flexible floor coverings, the elongate locking pin 20 can range in length from about 1 inch to about 80 inches, more preferably from about 20 inches to about 66 inches and most preferably from about 31 inches to about 40 inches. Locking pin 20 is preferably provided as a relatively rigid element, and can be made of plastic, metal, wood, composite, fiberglass or other durable material. In a preferred embodiment, the locking pin 20 has a raised central portion 32 and a pair of oppositely disposed locking edges 34. The locking edges 34 are spaced outwardly from the central portion 32. The relative size and shape of locking pin 20 is preferably "corresponding" to the conformation of at least a portion of the housing cavity to prevent significant displacement and/or rotation after insertion. For example, in the examples shown in FIGS. 1 and 2, the lower portion 16 of the housing interior has a generally angled conformation. Locking pin 20 is correspondingly shaped in an angled manner, with a raised central portion 35. The outwardly extending locking edges 34 are also sized to overlap the locking lips 18 of the elongate housing 12 as best seen in FIG. 1.

The elongated housing 12 might advantageously be attached to a flange 22 to aid in securing the elongate housing 12 to the display mechanism. The flange may extend the longitudinal length of the elongate housing or some portion thereof. A preferred display mechanism might further comprise a track-bar, a swivel mount or a pulley system and the like. The exemplary track-bar display mechanism illustrated comprises a wheel 30 being mounted on flange 22 of the elongate housing 12. The wheel is then inserted into a track or channel (not shown) in the display mechanism. One or more wheels can be attached to the flange for added stability and ease of use, and to support floor coverings or other flexible material of different sizes and weights. The elongate housing 12 is then rolled completely into the track or channel. A stop device would generally be installed on the end of the track or channel to prevent the elongate housing from being inadvertently completely removed from the track or channel. In another embodiment of the display mechanism, the elongate housing is attached by means known to one skilled in the art to a swivel arm (not shown). This arm can swivel and turn to allow the consumer to more closely examine the floor covering material. Yet another application of the display mechanism might comprise a pulley system where the elongate housing is attached to a pulley system which enables the consumer to lower the floor covering material that he or she is interested in inspecting. By utilizing a pulley system, all of the remaining floor covering material being displayed would be raised out of the direct view of the consumer, which allows the consumer to more efficiently examine the selected floor covering material.

Figure 3:
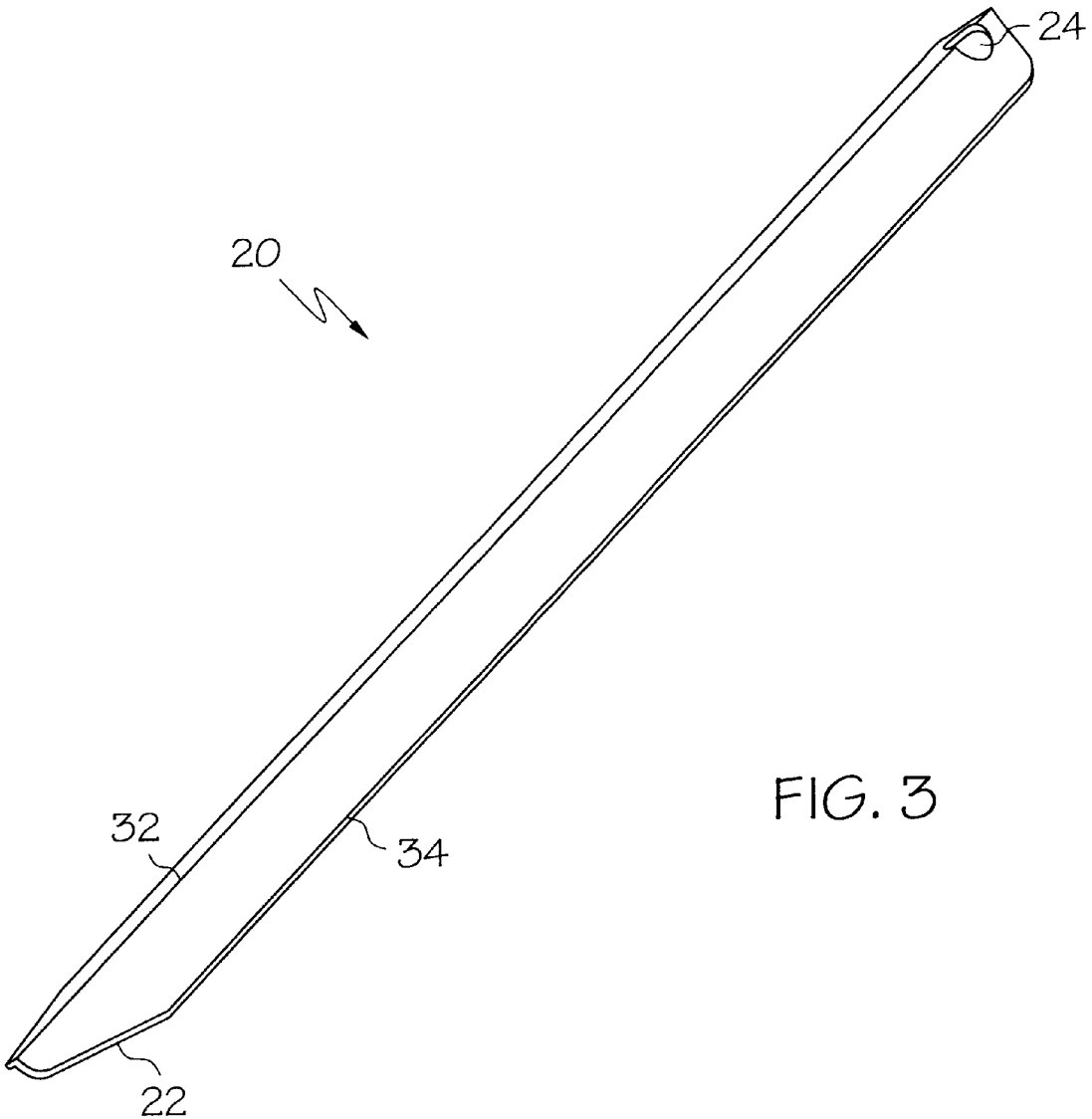
FIG. 3 is a longitudinal view of a preferred embodiment of a locking pin for use in the apparatus for displaying floor covering and other flexible materials.

FIG. 3 illustrates a particularly preferred embodiment of the elongate locking pin of the present invention. In this example, a tapered end 22 is provided to facilitate the sliding insertion of the locking pin 20 into the housing 12 once the flexible material has already been inserted. A finger grip 24 situated at the end opposite of the tapered end allows the locking pin 20 to be removed from the housing 12 with ease. In another embodiment, the locking pin might comprise a finger grip and tapered end at each end of the locking pin, whereby the pin could be inserted into a housing to secure flexible material in either direction. In other embodiments, the locking pin can comprise a flat bar, a dowel-shaped, triangular-shaped or block-shaped pin and the like. One or more locking pins may also be utilized in the present invention. The use of additional locking pins is preferred when the elongate housing is greater than 40 inches in length. In a situation where two elongate locking pins are to be utilized, the locking pins would preferably be are inserted from opposite ends of the elongate housing. As yet a further alternative, however, numerous modular locking pins could be provided with connector ends which permit selective linking of successive locking pins together, so that several lengths of such locking pins could be inserted from either end as desired.

In another embodiment of the present invention, the opening 19 of the lower portion 16 of the cavity might be provided with a width W equal to or greater than twice the thickness (t) of a floor covering material 10. In yet another embodiment, the upper portion 14 might have a width $W_2$ equal to or greater than twice the thickness of a floor covering material 10.

In the embodiment shown in FIGS. 1–3, the locking pin 20 has a raised central portion 32 and a pair of oppositely disposed locking edges 34. The locking edges 34 are spaced outwardly from the central portion 32. The relative size and shape of the locking pin 20 is preferably "corresponding" to the conformation of at least a portion of the housing cavity to prevent significant displacement and/or rotation after insertion. For example, in the examples shown in FIGS. 1 and 2, the lower portion 16 of the housing interior has a generally angled conformation. Locking pin 20 is correspondingly shaped in an angled manner, with a raised central portion 35. The outwardly extending locking edges 34 are also sized to overlap the locking lips 18 of the elongate housing 12 as best seen in FIG. 1 The overlap of the locking pin displaces the floor covering or other flexible material out over the locking edges, which secures the material in the housing.

One aspect of the present invention also includes an improved method for displaying floor covering material. As will be understood from the discussion herein, an elongate housing 12 is provided which has a cavity and a pair of oppositely spaced, inwardly disposed locking lips 18 which define an opening 19 to the cavity. A portion of the flexible material or floor covering material 19 is inserted into the cavity and then an elongate locking pin 20, dimensioned to comfortably fit into the lower portion of the cavity with the flexible material, is provided. As mentioned, the locking pin 20 can preferably have a tapered end 22 to facilitate sliding insertion into the elongate housing 12 and along the flexible material therewithin. The elongate locking pin 20 is then inserted into the lower portion 16 of the cavity to secure the flexible material 10 within the elongate housing 12. As it is slid into place, the elongate locking pin 20 preferably displaces the flexible material 10 outwardly beyond the inner edges of the locking lips 18, thereby inhibiting the removal of the floor covering material 10 from the elongate housing 12 while the locking pin 20 is located in the cavity. The elongate housing is then secured (e.g. hung on a rack or channel) to a display mechanism to display the flexible material. As also mentioned, in one preferred embodiment, the elongate housing 12 appropriately is fitted into a track or channel which secures the wheel(s) 30 that are attached to the housing.

The apparatus of the present invention can be used to display one or more flexible products such as floor covering material(s). To display two floor covering materials, an end of each material is inserted into the cavity of the elongate housing. In another embodiment, the apparatus can be used to display one piece of the floor covering material. The material can be looped, where each end of the floor covering material is inserted into the housing; or the floor covering material can be displayed in its entirety lengthwise. If the material is to be looped, each end of the floor covering material is inserted into the housing and secured with the locking pin. If the material is to be displayed in its entirety lengthwise, only one end of the material is placed in the elongate housing and is secured with the elongate locking pin. The apparatus can be utilized to display either side of the floor covering material desired by the consumer.

Another embodiment of the present invention is a clip arrangement for securing two unattached edges of flexible material. The clip arrangement comprises a longitudinal housing and a locking pin. The longitudinal housing has an interior chamber, a lower open surface and at least one open end. A pair of oppositely spaced locking lips are adjacent to the lower open surface. The locking lips are located at least partially within the interior chamber. The locking pin is a relatively rigid locking pin having a longitudinal length, a raised central portion and a pair of oppositely disposed locking edges. The locking edges are spaced outwardly from the central portion to effectively overlap the respective locking lips of the longitudinal housing. In another embodiment, the longitudinal housing further comprises an inner housing conformation to prevent significant rotation of the locking pin after insertion into the housing. In yet another embodiment of the invention, the longitudinal housing comprises an upper chamber and a lower chamber. The locking lips are located at least partially within the lower chamber. In another embodiment, a transition exists between the upper chamber and the lower chamber of the longitudinal housing.

The foregoing description of the preferred embodiment of the invention has been presented for the purposes of illustration and description. It is not intended to be exhaustive or to limit the invention to the precise form disclosed. Many alternatives, modifications, and variations will be apparent to those skilled in the art of the above teaching. Accordingly, this invention is intended to embrace all alternatives, modifications, and variations have been discussed herein, and others that fall within the spirit and broad scope of the claims.

I claim:

1. An apparatus for displaying floor covering material, the apparatus comprising:

a) an elongate housing comprising:

(I) walls defining a cavity having an upper portion and a lower portion;

(ii) a transition between the upper portion of the cavity and the lower portion of the cavity; and (iii) a pair of oppositely spaced inwardly disposed locking lips defining an opening in the lower portion of the cavity; and b) an elongate locking pin dimensioned to fit into the lower portion of the cavity for securing a floor covering material in the housing.

2. The apparatus of claim 1, wherein a floor covering material has a thickness and the opening of the lower portion of the cavity has a width equal to or greater than twice the thickness of a floor covering material.

3. The apparatus of claim 2, wherein the upper portion has a width equal to or greater than twice the thickness of a floor covering material.

4. The apparatus of claim 3, wherein the elongate locking pin, when fit into the lower portion of the cavity, displaces at least a portion of a floor covering material outwardly to a width greater than the opening in the lower portion of the cavity for securing a floor covering material in the elongate housing.

5. The apparatus of claim 1, wherein the locking lips are upwardly disposed.

6. The apparatus of claim 1, wherein the elongate locking pin comprises:

a) a raised central portion; and b) a pair of oppositely disposed locking edges spaced outwardly from the central portion to overlap the locking lips of the elongate housing.

7. The apparatus of claim 1, wherein the elongate locking pin comprises a tapered end.

8. The apparatus of claim 1, further comprising a flange connected to the elongate housing.

9. A method for displaying floor covering material, comprising the steps of:

a) providing an elongate housing having a cavity and a pair of oppositely spaced inwardly disposed locking lips defining an opening to the cavity;

b) providing an elongate locking pin;

c) inserting a portion of a floor covering material into the cavity; and d) inserting the elongate locking pin into the cavity to secure the floor covering material in the elongate housing.

10. The method of claim 9, wherein the floor covering material includes a first end and a second end, and step (c) comprises inserting the first and second ends into the housing resulting in a loop of material outside the housing and two lengths of material in the housing.

11. The method of claim 10, wherein the locking pin is positioned between the two lengths of material.

12. The method of claim 11, wherein the locking pin displaces the floor covering material outwardly towards the locking lips.

13. The method of claim 11, further comprising the steps of restricting the elongate pin from significant displacement or rotation by providing a transition in the cavity.

14. The method of claim 10, wherein a first floor covering material has a first end and a second floor covering material has a second end, and step (c) comprises inserting the first and second ends into the cavity such that a length of the first and second floor covering materials are positioned in the housing.

15. The method of claim 14, wherein step (c) comprises positioning the locking pin between the lengths of the first and second floor covering materials in the housing.

16. A clip arrangement for securing two unattached edges of flexible material comprising:

a longitudinal housing having an interior chamber, a lower open surface, and at least one open end;

a pair of oppositely spaced locking lips adjacent said lower open surface, said lips located at least partially within said chamber;

a relatively rigid locking pin having a longitudinal length, a raised central portion, and a pair of oppositely disposed locking edges, said locking pin adapted to be selectively inserted longitudinally into said chamber via at least one open end; and said locking edges being spaced outwardly from said central portion sufficiently to effectively overlap respective locking lips in use.

17. A clip arrangement according to claim 16, wherein said longitudinal housing further comprises an inner housing conformation and said locking pin corresponds with said housing conformation to prevent significant rotation after insertion of said locking pin.

18. A clip arrangement according to claim 16, wherein said longitudinal housing further comprises an upper chamber and a lower chamber.

19. A clip arrangement according to claim 18, wherein said locking lips are located at least partially within said lower chamber.

20. A clip arrangement according to claim 18, further comprising a transition between the upper chamber and lower chamber of the longitudinal housing.

* * * * *